US009187157B1

(12) United States Patent
Cooper

(10) Patent No.: US 9,187,157 B1
(45) Date of Patent: Nov. 17, 2015

(54) STAND UP PADDLEBOARD WITH PADDLE SHEATH

(71) Applicant: Corey Cooper, Destin, FL (US)

(72) Inventor: Corey Cooper, Destin, FL (US)

( * ) Notice: Subject to any disclaimer, the term of this patent is extended or adjusted under 35 U.S.C. 154(b) by 14 days.

(21) Appl. No.: 14/321,764

(22) Filed: Jul. 1, 2014

(51) Int. Cl.
*B63B 35/79* (2006.01)

(52) U.S. Cl.
CPC ..... *B63B 35/7906* (2013.01)

(58) Field of Classification Search
CPC .... B63B 35/7906; B63B 35/79; B63B 35/58; B63B 35/73; B63B 35/7933; B63B 2035/794
USPC ..... 441/74, 79; 114/364
See application file for complete search history.

(56) References Cited

U.S. PATENT DOCUMENTS

| | | | | |
|---|---|---|---|---|
| 4,595,373 | A | 6/1986 | Giroux | |
| 6,659,822 | B1 | 12/2003 | Dombeck | |
| 6,755,145 | B2 | 6/2004 | Bolebruch | |
| 2007/0240625 | A1 | 10/2007 | Kicker | |
| 2012/0312852 | A1 | 12/2012 | Smalley | |
| 2012/0318183 | A1 | 12/2012 | Chen | |
| 2013/0056509 | A1 | 3/2013 | Fuller | |
| 2013/0189886 | A1* | 7/2013 | Yeh | B63B 35/793 441/79 |
| 2013/0340661 | A1 | 12/2013 | Siverts at al. | |
| 2014/0137791 | A1* | 5/2014 | Bragman | A01K 97/10 114/364 |

OTHER PUBLICATIONS

"SUPerFISHa1," Jackson Kayak website.

* cited by examiner

*Primary Examiner* — Anthony Wiest
(74) *Attorney, Agent, or Firm* — Richard C. Litman

(57) ABSTRACT

The stand up paddleboard with paddle sheath is a paddleboard having a sheath or receptacle formed therein for removably and releasably holding the blade of a stand up paddle while the paddleboard is in use. The stand up paddleboard includes a buoyant paddleboard body having opposed front and rear ends. A sheath recess is formed in the buoyant paddleboard body proximate the front end thereof and extends downwardly from an upper surface of the buoyant paddleboard body. A sheath is provided, having an open upper end, a closed lower end and at least one sidewall. The sheath is received within the sheath recess such that the open upper end thereof is adjacent the upper surface of the buoyant paddleboard body. In use, a blade of a paddle may be releasably and removably inserted within the sheath.

5 Claims, 5 Drawing Sheets

STAND UP PADDLEBOARD WITH PADDLE SHEATH

BACKGROUND OF THE INVENTION

1. Field of the Invention

The present invention relates to buoyant watercraft, and particularly to a stand up paddleboard having a paddle sheath for releasably holding a blade of a paddle used with the stand up paddleboard.

2. Description of the Related Art

Stand up paddle surfing is similar to traditional paddleboarding, except the user stands on the paddleboard and uses a separate paddle to propel the board, whereas in traditional paddleboarding, the user is propelled by a swimming motion made with the arms while lying or kneeling on the paddleboard. A paddleboard is somewhat similar to a surfboard, though paddleboards tend to be larger than a conventional surfboard. Similar to surfboards, paddleboards are constructed from buoyant, water resistant materials, such as fiberglass, epoxy and/or carbon fiber, for example, and may have lengths ranging between eight feet and twenty one feet. A typical paddleboard used for stand up paddle surfing may be made from glass-reinforced plastic using a polyester or epoxy resin surrounding a polyurethane or expanded polystyrene foam core.

The stand up paddle is used to propel the user across the surface of the water while standing on the paddleboard. The paddle consists of a blade, shaft and handle, similar to a traditional canoe paddle, but typically longer. Stand up paddles are usually constructed from carbon, fiberglass or wood, with a flat blade on one end connected to a handle on the other end by a long smooth shaft. The blade may range between approximately six inches and ten inches in width, with a shaft ranging between approximately 67 inches and 86 inches in length, typically with a diameter ranging between one inch and one and a half inches.

The proper form for paddle surfing requires a paddle of the correct length and size. A paddle is typically selected to extend approximately five to seven inches above the rider's height. While standing on the paddleboard, the rider holds the paddle with one hand on the handle and with the other hand approximately one-third of the way down the shaft. The hand placement alternates depending on which side the rider is paddling on. When paddling on the right side, the handle is held with the left hand and the shaft is held with the right hand, and vice versa. When paddling, the blade is placed in the water approximately one to two feet in front of the rider. The blade of the paddle pushes against the water and is used to pull the board past the paddle.

While riding the paddleboard, the user may wish to put the paddle down, such as when the user requires his or her hands for fishing, adjustment of equipment (such as headphones or the like), getting a drink of water, etc. Given that the user is balanced on the floating paddleboard at such times, it is obviously quite difficult to bend down or make any other movements required to place the paddle on the board, and then to later retrieve the paddle. Additionally, the paddle may easily fall off of the board, into the water.

Thus, a stand up paddleboard with a paddle sheath solving the aforementioned problems is desired.

SUMMARY OF THE INVENTION

The stand up paddleboard with paddle sheath is a paddleboard having a sheath or receptacle formed therein for removably and releasably holding the blade of a stand up paddle.

The stand up paddleboard includes a buoyant paddleboard body having opposed front and rear ends. A sheath recess is formed in the buoyant paddleboard body proximate the front end thereof, and extending downwardly from an upper surface of the buoyant paddleboard body. A sheath is provided in the sheath recess, having an open upper end, a closed lower end and at least one sidewall. The sheath is received within the sheath recess such that the open upper end thereof is adjacent the upper surface of the buoyant paddleboard body. Preferably, the lower end of the sheath extends toward the front end of the buoyant paddleboard body such that an angle of about 45° is formed with respect to the upper surface of the paddleboard body. In use, a blade of a paddle may be releasably and removably inserted within the sheath.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
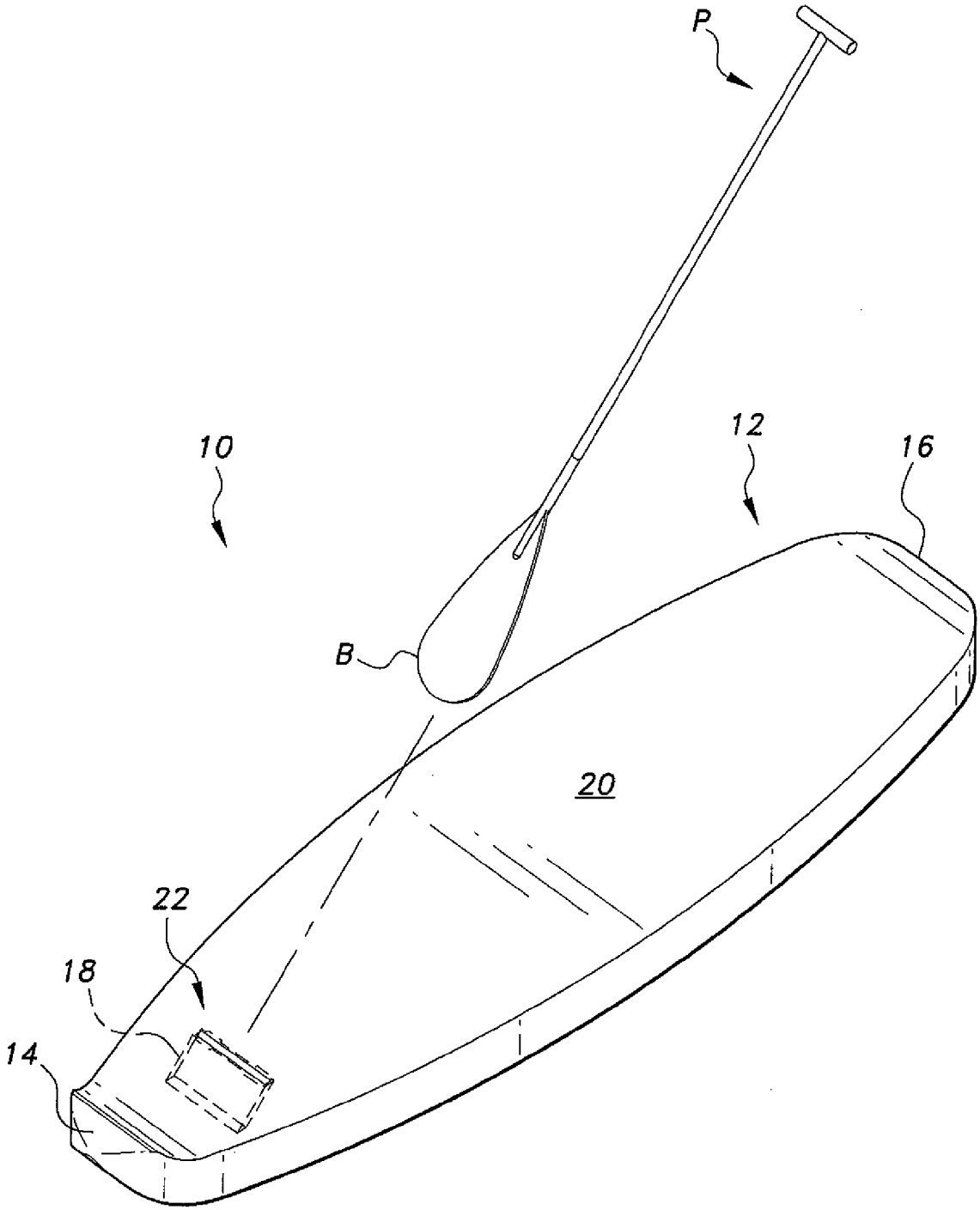
FIG. 1 is a perspective view of a stand up paddleboard with paddle sheath according to the present invention.
Figure 2:
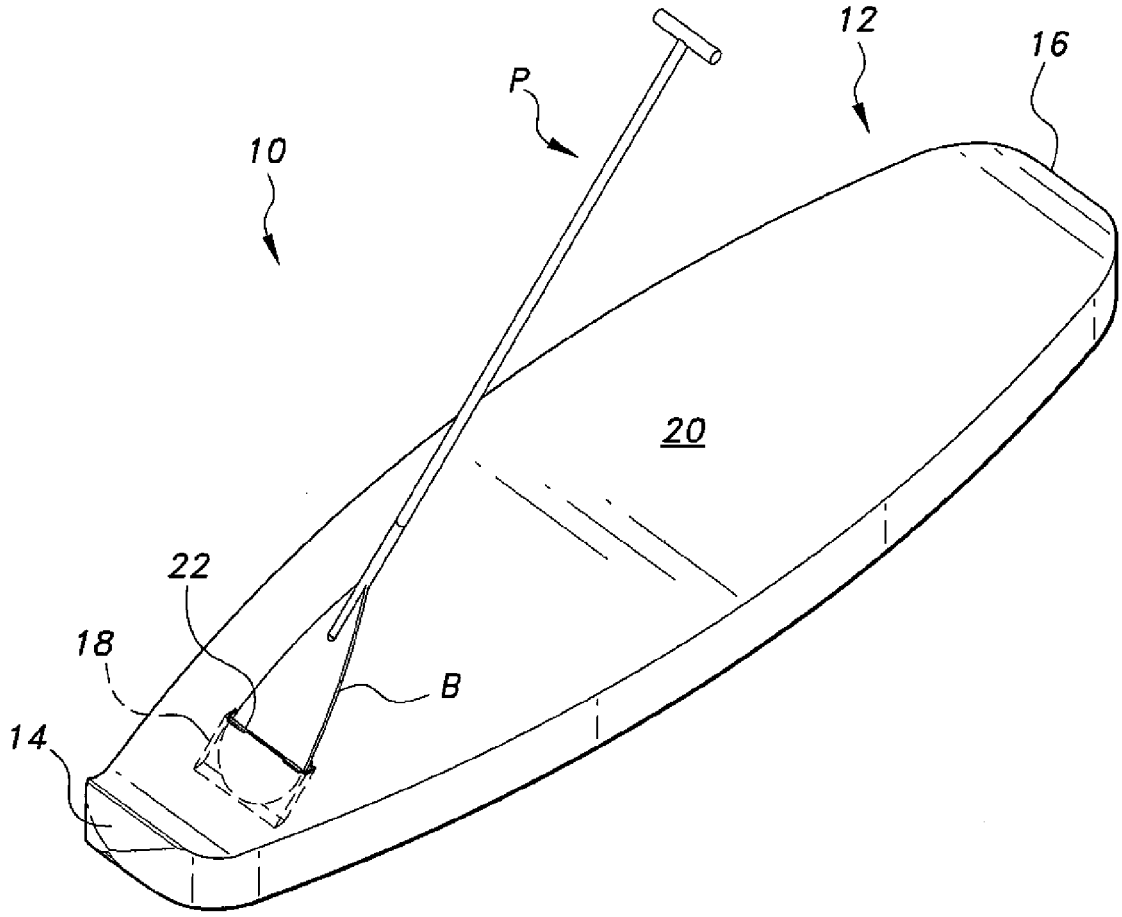
FIG. 2 is a perspective view of the stand up paddleboard with paddle sheath according to the present invention, showing a paddle blade inserted within the paddle sheath.
Figure 3:
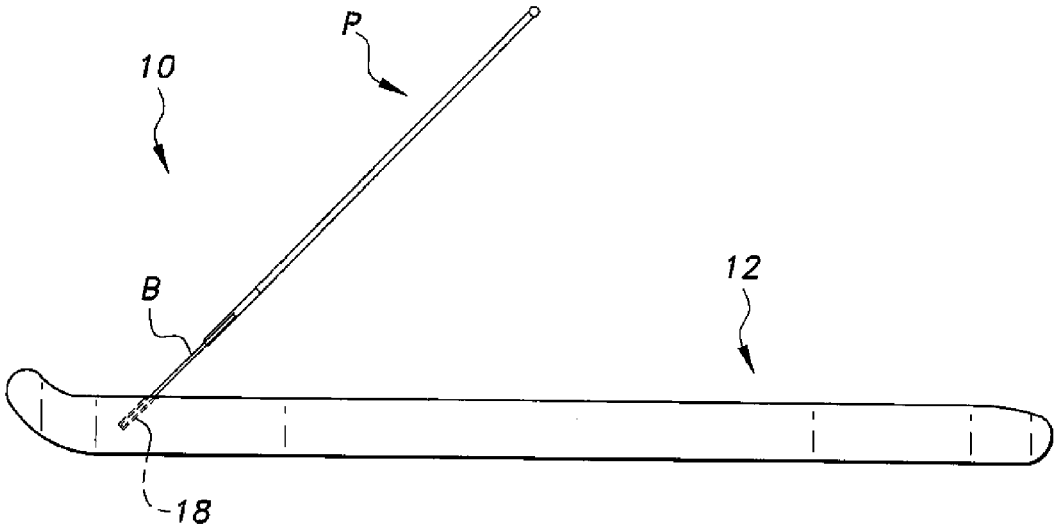
FIG. 3 is a side view of the stand up paddleboard with paddle sheath according to the present invention, showing a paddle blade inserted within the paddle sheath.
Figure 4:
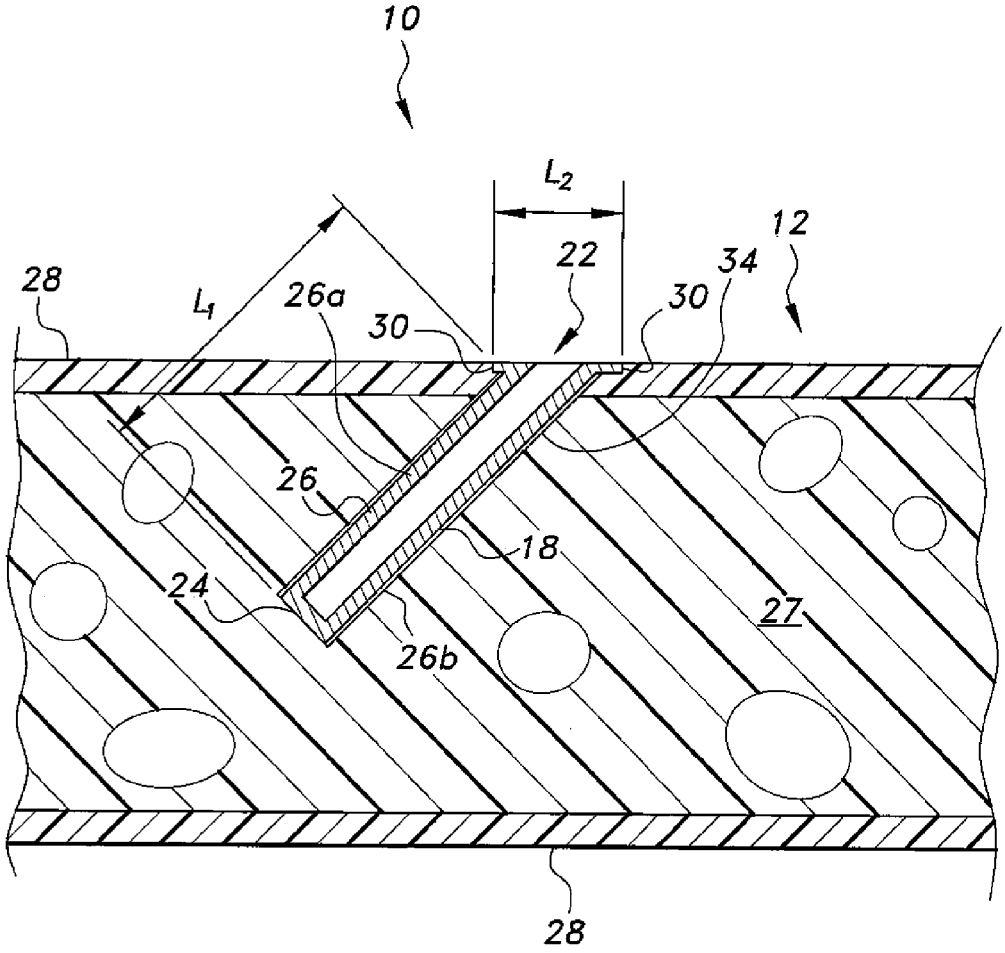
FIG. 4 is a partial side view in section of the stand up paddleboard with paddle sheath according to the present invention.

As shown in FIGS. 1-3, the stand up paddleboard with paddle sheath 10 includes a paddleboard having a sheath 18 or receptacle formed therein for removably or releasably holding the blade B of a stand up paddle P. A user may position the blade B of the paddle P in the sheath 18 while the paddleboard is in use to facilitate hands-free operation of the board as well as easy access to the paddle when the paddle is needed for use. The stand up paddleboard 10 includes a buoyant paddleboard body 12 having opposed front and rear ends 14, 16, respectively. The paddleboard body 12 may be sized and contoured in any suitable manner known in the art to facilitate stand up paddle surfing and the paddle sheath 18 may be integrally formed therein. It should be understood that the buoyant paddleboard body 12 shown in FIGS. 1-3 is shown for exemplary purposes only, and may have any desired relative dimensions or overall contouring. As best shown in FIG. 4, the buoyant paddleboard body 12 may be constructed from a glass-reinforced plastic or the like, using a polyester or epoxy resin shell 28 surrounding a polyurethane or expanded polystyrene foam core 27 or the like, as is known in the art.

Figure 5:
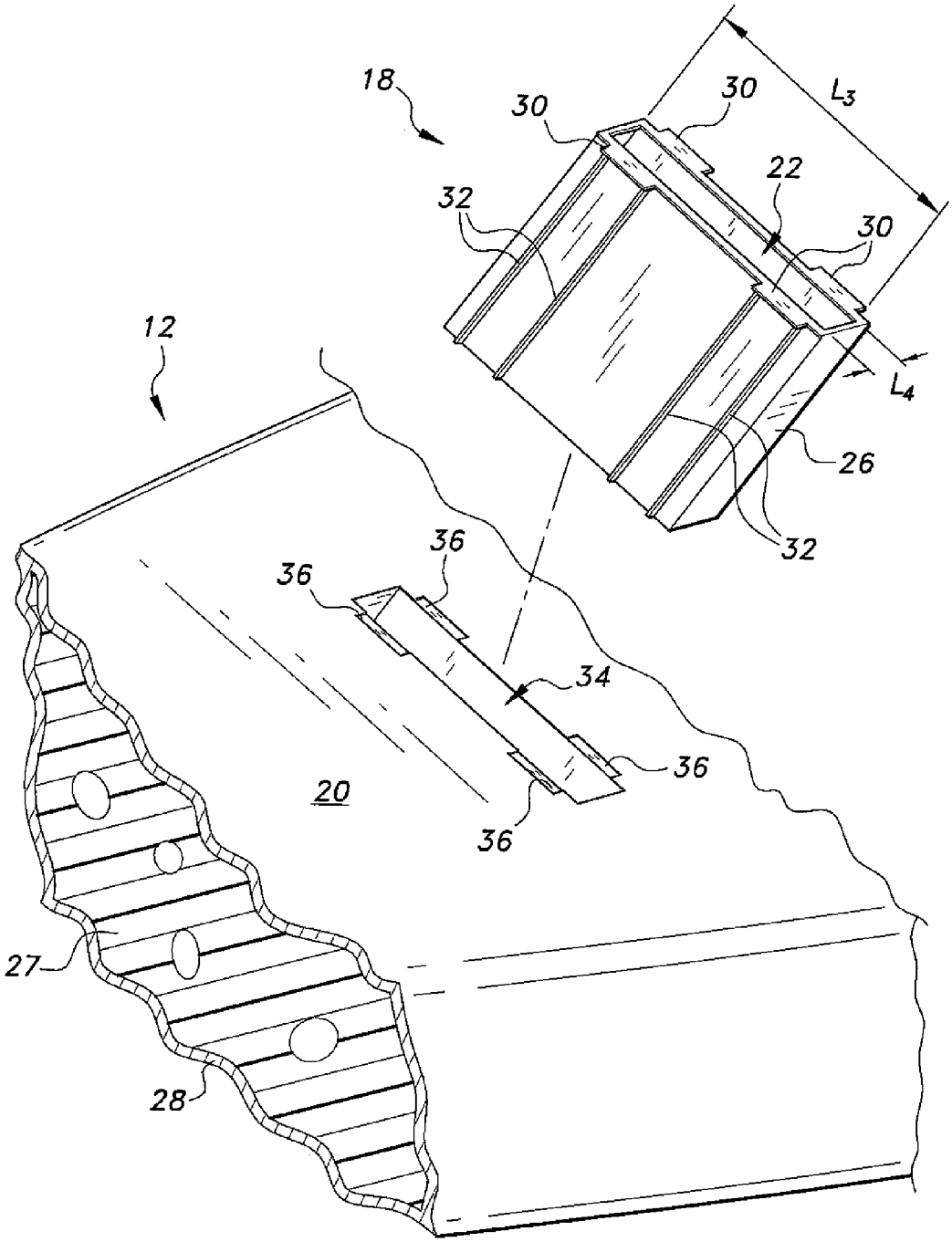
FIG. 5 is a partial exploded view of the stand up paddleboard with paddle sheath.

As best shown in FIG. 5, a sheath recess 34 is formed in the buoyant paddleboard body 12, proximate, e.g., adjacent, the front end 14 and extending downwardly from an upper surface 20 of the buoyant paddleboard body 12. The sheath recess 34 is configured to securely retain a sheath 18 therein. The size and relative dimensions of sheath recess 34 may closely match those of the sheath 18 such that no gaps are present between the sheath recess 34 and the sheath 18. As shown in FIG. 4, the sheath 18 has an open upper end defining a slot 22, a closed lower end 24 and at least one sidewall 26. In a preferred embodiment, the sheath 18 has a substantially rectangular cross-sectional contour, with sheath 18 including four sidewalls, e.g., front sidewall 26*a*, rear sidewall 26*b*, and end sidewalls (not shown). As shown in FIG. 4, the sheath 18 is received within the sheath recess 34 such that the open upper end (defining slot 22) is adjacent to the upper surface 20 of the buoyant paddleboard body 12. As shown, the upper end of sheath 18 is preferably positioned flush with the upper surface 20.

Preferably, the sheath 18 extends or is angled toward the front end 14 of the buoyant paddleboard body 12, such that an angle about 45° with respect to the upper surface 20 is formed. For example, once the sheath 18 is positioned in the sheath recess 34, an angle formed between the front sidewall 26*a* and the upper surface 20 may be about 45°. The sheath 18 is positioned at a slant with respect to the upper surface 20, and the lower end 24 of the sheath 18 is closer to the front end 14 of the buoyant paddleboard body 12 than is the upper end 22 of the sheath 18. In use, a blade B of a paddle P may be releasably and removably inserted within the sheath 18. When the blade B of the paddle P is positioned in the sheath 18, the handle portion of the paddle P is at a height approximately corresponding to a user's shoulder level and a distance of approximately one foot from the user. As shown in FIGS. 2 and 3, the slant or angling of the sheath 18 allows the paddle P to be angled toward the user for easy placement and removal of the paddle P when the user is standing on upper surface 20. The angling allows the user to insert the blade within sheath 18 using a motion similar to that used in paddling. Further, due to the angling, when blade B is inserted within sheath 18, the weight of the handle portion of paddle P creates a torque (a clockwise torque in the orientation of FIG. 3) or a tendency to cause a force on the handle, which urges the blade B against the inner face of the front sidewall 26*a* of sheath 18, thereby increasing frictional engagement between blade B and the inner face of the front sidewall 26*a* and securing blade B in place. Insertion of the blade B in the sheath 18 is sufficient to hold the paddle P in place even while the paddleboard body 12 is being bounced around on the water.

As shown in FIGS. 4 and 5, the sheath 18 may include at least one tab 30 for engaging at least one tab recess 36 formed in the upper surface 20 of the buoyant paddleboard body 12 adjacent the sheath recess 34. As shown, the at least one tab 30 extends outwardly, e.g., horizontally, from the open upper end of the sheath 18. Although four such tabs are shown in FIG. 5, it should be understood that the number, as well as the relative dimensions and overall contouring, of the tabs 30 may be varied, dependent upon the particular needs and desires of the user. The engagement of tabs 30 in the respective recesses 36 allows for proper alignment and securement of the sheath 18 within the sheath recess 34 during manufacture.

In addition to tabs 30, at least one vertically extending rib 32 may be formed on an outer face of the at least one sidewall 26. It should be understood that the ribs 32 shown in FIG. 5 are shown for exemplary purposes only, and that the number, positioning and overall sizes and contouring of the ribs 32 may be varied, dependent upon the particular needs and desires of the user. The ribs 32 are provided for engaging core material 27 for securing the sheath 18 within the sheath recess 34.

It should be understood that sheath 18 may have any desired relative dimensions or overall contouring for securely engaging the blade B of paddle P. For a conventional blade B, sheath 18 may have a longitudinal length (i.e., depth) $L_1$ of approximately 2.34 inches, with a width of the upper end $L_2$ being approximately 1.25 inches. The lateral length $L_3$ of the slot 22 may be approximately 8.65 inches, with a thickness $L_4$ of approximately 0.354 inches. It should be understood that these dimensions are given for exemplary purposes only.

It is to be understood that the present invention is not limited to the embodiments described above, but encompasses any and all embodiments within the scope of the following claims.

I claim:

1. A stand up paddleboard with paddle sheath, comprising: a buoyant paddleboard body having opposed front and rear ends, a sheath recess being formed in the buoyant paddleboard body adjacent the front end thereof, said sheath recess formed by a substantially rectangular slot having a major dimension oriented transverse to a line connecting the front and rear end of said paddleboard, said slot extending downwardly at an angle from an upper surface of the buoyant paddleboard body; and a sheath having an open upper end, a closed lower end and at least one sidewall, said sheath having a substantially rectangular cross-sectional contour and being received within the sheath recess such that the open upper end thereof is adjacent the upper surface of the buoyant paddleboard body, said closed lower end of said sheath extending toward the front end of said buoyant paddleboard body and said sheath extending at an angle with respect to the upper surface of the buoyant paddleboard body, whereby a blade of a paddle may be releasably and removably inserted within said sheath.

2. The stand up paddleboard with paddle sheath as recited in claim 1, wherein said sheath extends toward the front end of said buoyant paddleboard body at an angle of approximately 45° with respect to the upper surface of said buoyant paddleboard body.

3. The stand up paddleboard with paddle sheath as recited in claim 2, wherein said sheath further comprises at least one tab for engaging at least one tab recess formed in the upper surface of the buoyant paddleboard body adjacent the sheath recess, the at least one tab extending horizontally from the open upper end of said sheath.

4. The stand up paddleboard with paddle sheath as recited in claim 3, wherein said sheath further comprises at least one vertically extending rib formed on an outer face of the at least one sidewall.

5. The stand up paddleboard with paddle sheath as recited in claim 1, wherein said upper end of said sheath is substantially flush with the upper surface of the paddle board body.

* * * * *